US006266821B1

(12) United States Patent
Quintana

(10) Patent No.: US 6,266,821 B1
(45) Date of Patent: Jul. 31, 2001

(54) BABY BLANKET

(76) Inventor: Daniel T. Quintana, 8208 N. 45th Ave., Glendale, AZ (US) 85302

( * ) Notice: Subject to any disclaimer, the term of this patent is extended or adjusted under 35 U.S.C. 154(b) by 0 days.

(21) Appl. No.: 09/546,542

(22) Filed: Apr. 10, 2000

Related U.S. Application Data

(63) Continuation-in-part of application No. 09/332,484, filed on Jun. 14, 1999, now abandoned.

(51) Int. Cl.[7] ..... A41B 13/00
(52) U.S. Cl. ..... 2/69.5; 2/83
(58) Field of Search ..... 2/69, 69.5, 48, 2/75, 80, 114, 83; 5/413, 655, 416, 494

(56) References Cited

U.S. PATENT DOCUMENTS

| | | | | |
|---|---|---|---|---|
| 1,423,908 | | 7/1922 | Burchard . | |
| 1,915,044 | | 6/1933 | Anderson . | |
| 1,940,224 | * | 12/1933 | Munro | 5/343 |
| 2,242,130 | * | 5/1941 | Hutchison | 2/69.5 |
| 2,292,600 | * | 8/1942 | Baum | 2/69 |
| 2,399,782 | | 5/1946 | Asher . | |
| 2,444,652 | * | 7/1948 | Joyce | 2/69.5 |
| 2,496,922 | * | 2/1950 | Virtue | 2/69.5 |
| 2,579,276 | * | 12/1951 | Schworm | 2/69.5 |
| 2,613,359 | * | 10/1952 | Boyce | 2/69.5 |
| 2,652,052 | * | 9/1953 | Smith | 2/69.5 |
| 3,304,556 | * | 2/1967 | Meyers et al. | 2/69.5 |
| 3,564,629 | * | 2/1971 | Rogius | 2/69.5 |
| 3,693,190 | | 9/1972 | Hickling . | |
| 4,295,230 | * | 10/1981 | Blodgett | 2/69.5 |
| 4,484,362 | | 11/1984 | Asher . | |
| 4,790,040 | * | 12/1988 | Grilliot et al. | 5/413 |
| 4,884,303 | | 12/1989 | Scherer . | |
| 4,897,885 | * | 2/1990 | Lunt | 2/69.5 |
| 5,046,204 | | 9/1991 | Mohler . | |
| 5,243,724 | * | 9/1993 | Barnes | 5/482 |
| 5,842,827 | | 12/1998 | Lear . | |
| 5,988,742 | * | 11/1999 | Stevens | 297/219.12 |
| 6,009,576 | | 1/2000 | Gramme et al. . | |

* cited by examiner

*Primary Examiner*—John J. Calvert
*Assistant Examiner*—Tejash Patel
(74) *Attorney, Agent, or Firm*—Charles E. Cates; Elizabeth A. Dawn

(57) ABSTRACT

A baby blanket of two layer construction which is generally rectangular in shape. The two layers are joined by one seam running along the bottom of the bag and a second seam running up the midline on the front of the bag. The midline seam runs from the bottom of the bag to about two-thirds of the distance to the top. The top ⅓ of the midline seam is left open. Means for releasably attaching the two sides of the blanket top are provided on the top of the blanket on each side of the open midline seam. In use, a baby is inserted into the top open end of the blanket. The two sides of the blanket top are then secured about the baby under its arms by the means for releasably attaching the two sides.

13 Claims, 3 Drawing Sheets

BABY BLANKET

This is a continuation-in-part of U.S. patent application Ser. No. 09/332,484, filed Jun. 14, 1999, now abandoned. This invention relates to a baby blanket which is closed at the sides and bottom with a top open end. Means is provided at the top open end for securing the blanket under the arms of a baby.

BACKGROUND OF THE INVENTION

Various means have been considered to prevent a baby from throwing off its covers and becoming chilled. Attempts to keep a child covered have included blankets which are secured to a bed. With this type of blanket, the blanket is secured to a bed, and the child is then secured under the blanket, for example, by shoulder straps. Blankets which secure a child to a bed are taught by U.S. Pat. Nos. 2,503,427 and 2,702,385. Parents may find these blankets too confining for their children. Moreover, a child may become tangled in the straps and confining blanket, which may frighten the child or lead to injury. More recent efforts have included blankets which are secured about the child, but which are not attached to a bed. Of these patents, U.S. Pat. No. 5,243 to Barnes, U.S. Pat. No. 2,968,044 to Dudley, and U.S. Pat. No. 4,295,230 Blogett are of note. Barnes teaches a rectangular blanket in which the lower portion of the rectangle is formed into a pocket for receiving a child. The child is placed into the pocket and then the sides of the blanket are then rolled around the child. Straps are used to secure the blanket about the child's waist. Although blankets of this design provide a child with more freedom of movement than those blanket which attach to a bed, the Barnes blanket uses a lot of material which must be folded about the baby and left to flop about the baby's head. All this material restricts the baby's movement, adds weight to the blanket, and increases the cost of production. Blankets of a simpler, more efficient design are taught by Dudley and Blogett. Both Dudley and Blogett teach blankets of a bag design which are secured to a child. In the Blogett patent, the bag-like blanket is secured to the child by releasably fastened shoulder straps. Although the child can be easily inserted into the bag-like portion of the blanket, some manipulation of the child and the blanket is necessary to fasten the shoulder straps. All the activity necessary to secure a child within the blanket may be difficult with a squirming child and may also result in the unfortunate consequence of waking a sleeping child. Dudley teaches a bag-like blanket which is secured about a baby's waist using a draw-string tie. The Dudley blanket presents the problem of a baby becoming tangled in the tie string or choking on the string.

SUMMARY OF THE INVENTION

The baby blanket of the present invention is in the shape of a bag with a top open end. The sides and bottom of the bag are closed by one seam running along the bottom of the bag and a second seam running up the midline on the front of the bag. The midline seam runs from the bottom of the bag to about two-thirds of the distance to the top. The top ⅓ of the midline seam is left open. Means for releasably attaching the two sides of the blanket top are provided on the top of the blanket on each side of the open midline seam. In use, a baby is inserted into the top open end of the blanket. The two sides of the blanket top are then secured about the baby under its arms by the means for releasably attaching the two sides. The baby is able to kick and move its legs around within the blanket without kicking the blanket off. Thus, a baby will remain covered and keep warm for the duration of its nap or the night. The blanket of the present invention is easily and conveniently put on a baby such that the blanket can be secured about a baby even while the baby is asleep without waking the baby.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION OF THE PREFERRED EMBODIMENTS

Figure 1:
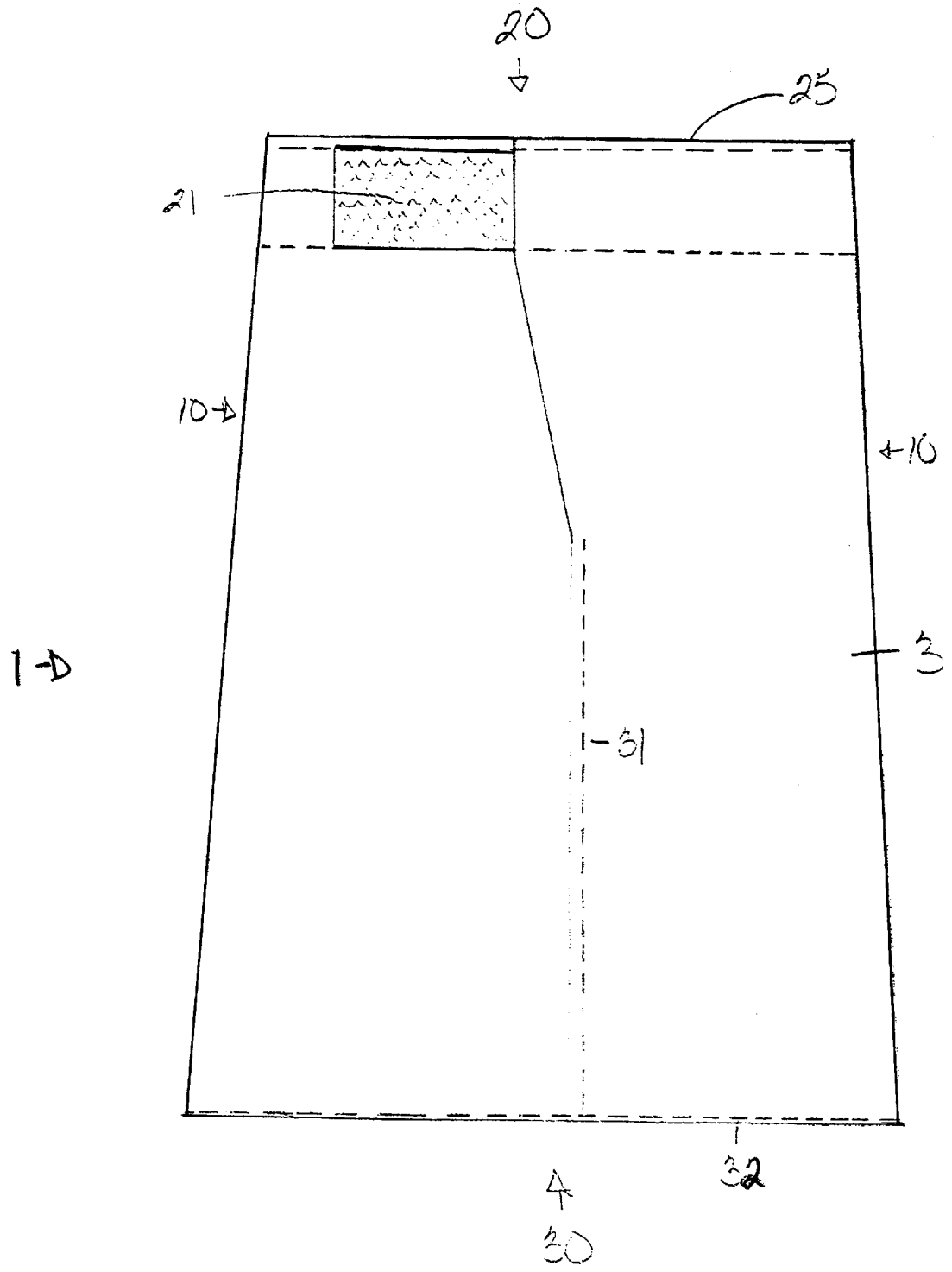
FIG. 1 is a front view of the baby blanket of the present invention showing the blanket in a closed position.

As shown in FIG. 1, the baby blanket 1 of the present invention is generally rectangular in shape, having two sides 10 of approximately equal length, a narrower top end 20 and a wider bottom end 30. The baby blanket is formed by joining a continuous piece of fabric at midline 31. Stitching is used to join the material along the bottom two-thirds of midline 31. The top third of midline seam 31 adjacent to top 20 is left unstiched and open creating a placket with flaps 27. A bottom seam 32 closes the bottom 30 of blanket 1. Top 20 is left open thereby forming a bag-like article of two layer construction with a top opening 25, an inside surface 2 and an outside surface 3.

Figure 2:
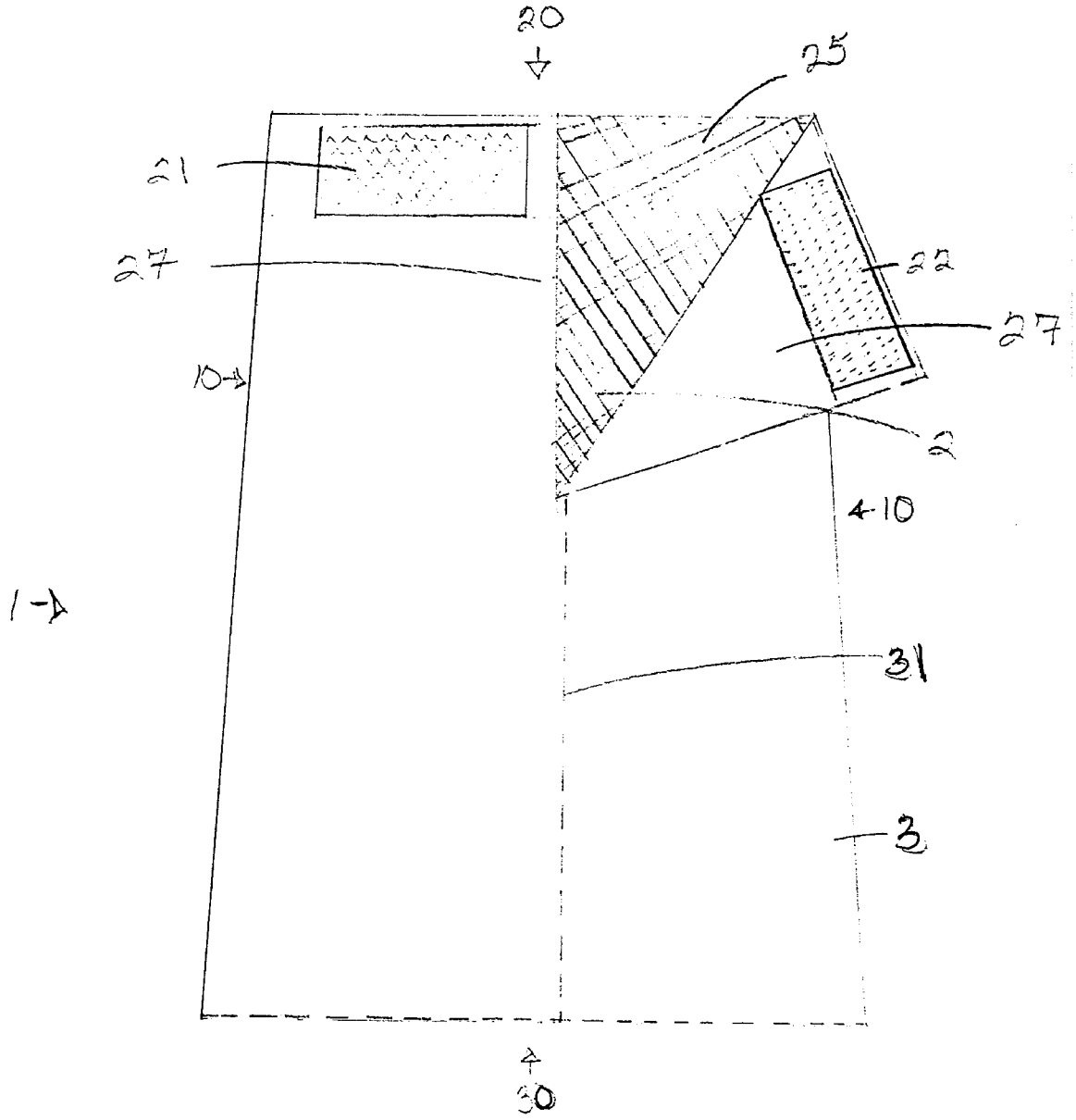
FIG. 2 is a front view of the baby blanket of the present invention showing the blanket in an open position.

As shown best in FIG. 2, hook and loop pads 21 and 22 are attached to flaps 27 on either side of midline 31. Pad 21 is attached to the top outside surface 3 of blanket 1 adjacent to midline 31 while pad 22 is attached to the top inside surface 2 of bag 1 adjacent to midline 31. By attaching pad 21 to pad 22, flaps 27 are closed.

In use, a child is inserted into blanket 1 though top opening 25. Flaps 27 are then secured about the child under its arms by attaching pad 21 to pad 22. The child's arms are thus positioned on the outside of blanket 1. Pads 21 and 22 should be of sufficient length so that by attaching pads 21 and 22 at various points on the pads, opening 25 can be adjusted to accommodate children of different sizes. Although hook and loop pads are the presently preferred means for closing the top portion of midline 31, other commercially available non-tying closing means, such as snaps, for releasably attaching flaps 27 may also be used.

Blanket 1 may be made in a variety of sizes to accommodate children of various weights and ages. Blanket 1 should be of sufficient length to be secured under the arms of a child while allowing sufficient room in the bottom of the blanket to allow a child to kick and move its legs. Blanket 1 may be made from a variety of fabric types depending on the amount of warmth desired.

Figure 3:
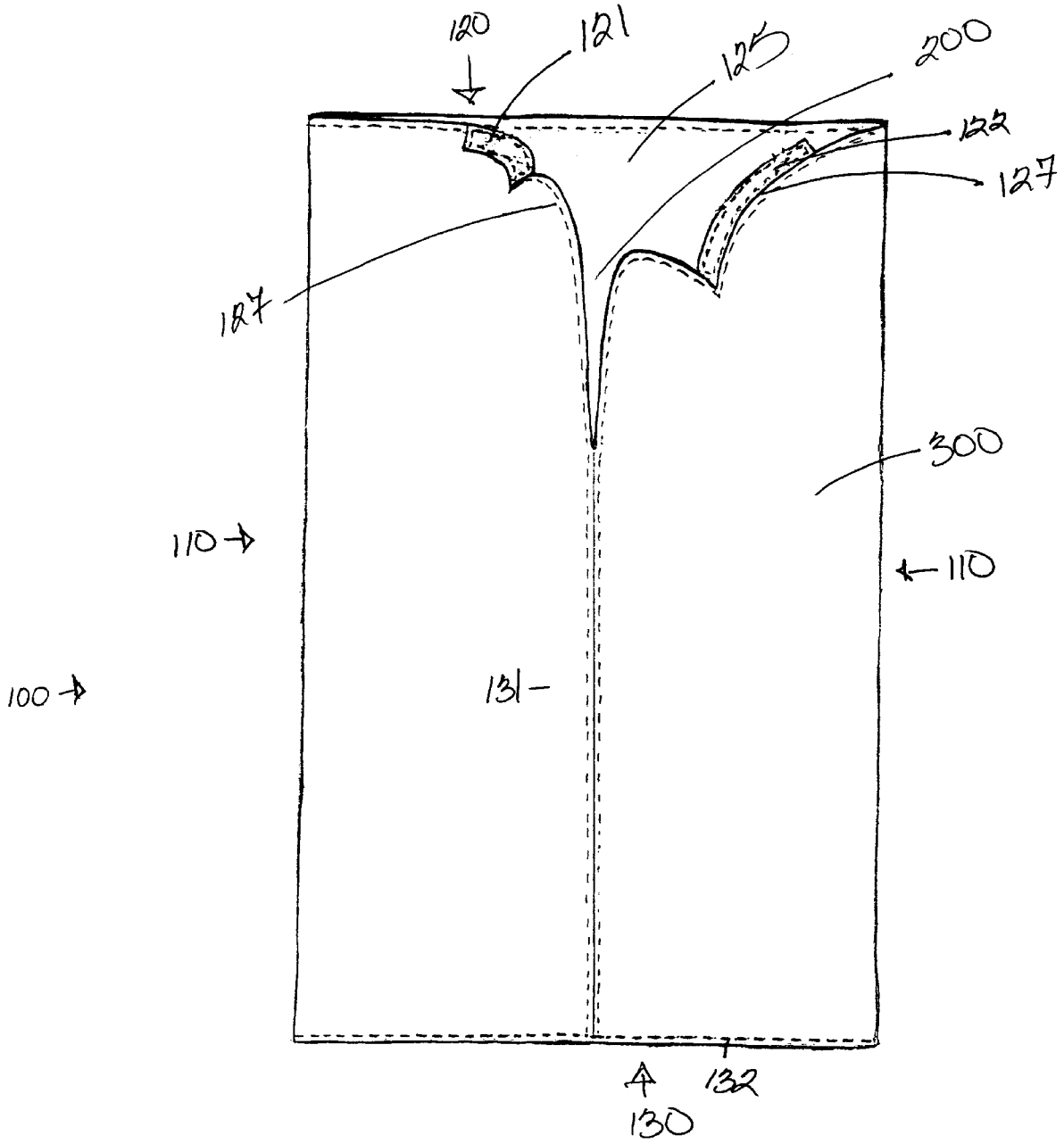
FIG. 3 is a front view of an alternate embodiment of the present invention.

Baby blanket 100 shown in FIG. 3 is an alternate embodiment of the present invention. Blanket 1 00 is generally rectangular in shape, having two sides 110 of approximately equal length, a top end 120 and a bottom end 130. Top end 120 and bottom end 130 are of approximately equal width. It is preferred that sides 110 have a length of about 22 inches and that top end 120 and bottom end 130 each have a width of about 11 inches. As with the previous embodiment, blanket 100 is formed by joining a continuous piece of fabric at midline 131. Stitching is sewed to join the material along the bottom two-thirds of midline 131. The top third of midline 131 adjacent to top 120 is left unstitched and open creating a placket with flaps 127. Bottom seam 132 closes the bottom 130 of blanket 100. Top 120 is left open thereby forming a bag-like article of two layer construction with a top opening 125, an inside surface 200 and an outside surface 300.

Hook and loop pads 121 and 122 are attached to flaps 127 on either side of midline 131. Pad 121 is attached to the top outside surface 300 of blanket 100 adjacent to midline 131 while pad 122 is attached to the top inside surface 200 of blanket 100 adjacent to midline 131. By attaching pad 121 to pad 122, flaps 127 are closed. It is preferred that pad 121 is about 1.5 to 2 inches long and about ¾ inch wide and that pad 122 is about 9 inches long and about ¾ inch wide.

Due to safety considerations, it is desirable that blanket 100 not be used with infants who are walking because there is a concern that when children stand in the blanket, their legs would become tangled in the material, and the child would fall. Consequently, blanket 100 is intended to be used only with infants who cannot yet walk. Where the closed end of the blanket is wider than the open end, an infant could move its legs sufficiently to stand in the blanket, which, as discussed above, might place the child in some danger. Accordingly, it is desirable that closed end 130 have a width equal to open end 120 so that leg movement in older infants is restricted. Where the widths of closed end 130 and open end 120 are equal, the process of manufacturing the blankets of the present invention is also made more effective.

In order to prevent the use of the blanket with children who are walking, blanket 100 is sized so that it will not fit average sized children over 9 months of age, the age when most children start walking. The average circumference of a newborn's chest is 13 inches while the average chest circumference of a 9 month old child is 19 inches. Accordingly, blanket 100 is sized so that it fits infants having a chest circumference of 13 to 19 inches. In the preferred embodiment, the top open end 120 and bottom closed end 130 have a width of about 11 inches, and sides 110 have a length of about 22 inches. Also in the preferred embodiment, hook and loop pad 121 is about 1.5 to 2 inches long and about ¾ inch wide, and hook and loop pad 122 is about 9 inches long and about ¾ inch wide. In the preferred embodiment of the invention, opening 125 can be shrunk to have a circumference of 12 inches and expanded to have a circumference of 20 inches, thereby allowing blanket 100 to be adjusted to fit a child from newborn to 9 months.

I claim:

1. A sleeping bag for a small child comprising two layers of material which are structured to form:

a. a first, narrower and open end of said bag formed from said two layers, said first end being free from interfering tie strings and straps;

b. a second, wider and closed end of said bag formed from said two layers;

c. approximately straight-line, closed sides connecting said layers and extending between said first and second ends of said bag;

d. means for causing said bag to be secured under the arms of a child at the chest;

e. the means for securing is defined as placket having two sides formed in one of said layers at said first end;

f. fastening means for adjustably securing one side of said placket to said other side, said fastening means being free of strings.

2. The blanket according to claim 1 wherein said means for adjustably securing one side of said placket to said other side may be joined at different points such that the diameter of said first end is sizable to fit said child under said child's arms.

3. The blanket according to claim 1 wherein said means for adjustably securing one side of said placket to said other side are hook and loop pads.

4. A blanket according to claim 1 wherein said placket is formed medially between said closed sides in one of said layers on said first end.

5. A sleeping bag for a small child comprising two layers of material which are structured to form:

a. a first open end formed from said two layers, said first end being free from interfering tie strings and straps;

b. a second closed end of said bag formed from said two layers, said second closed end having a width equal to said first open end;

c. approximately straight-line, closed sides connecting said layers and extending between said first and second ends of said bag;

d. means for causing said bag to be secured under the arms of a child at the chest;

e. the means for securing is defined as placket having two sides formed in one of said layers at said first end;

f. fastening means for adjustably securing one side of said placket to said other side, said fastening means being free of strings.

6. A blanket according to claim 5 wherein said placket has overlapping edge and is formed medially between said closed sides in one of said layers on said first end.

7. The blanket according to claim 6 wherein said sides have a length of about 22 inches and said first and second ends have a width of about 11 inches.

8. The blanket according to claim 6 wherein said means for adjustably securing one side of said placket to said other side may be joined at different points such that the diameter of said first end is sizable to fit said child under said child's arms.

9. The blanket according to claim 8 wherein said means for adjustably securing one side of said placket to said other side are hook and loop pads.

10. The blanket according to claim 9 wherein said means for adjustably securing one side of said placket to said other side are two hook and loop pads, one of which has a length of about 1.5 inches and the other which has a length of about 9 inches.

11. The blanket according to claim 9 wherein said means for adjustably securing one side of said placket to said other side are two hook and loop pads, one of which has a length of about 2 inches and the other which has a length of about 9 inches.

12. A method for securing a sleeping bag about a small child, said method comprising the steps of:

a. forming a sleeping bag comprising two layers of material, said layers being structured to form a first, narrower and open end, said first end being free from interfering tie strings and straps, a second, wider and closed end of said bag formed from said two layers, said bag having approximately straight-line, closed sides connecting said layers and extending between said first and second ends of said bag with means defining a placket having two sides, formed in one of said layers at said first end;

b. placing said sleeping bag under the arms of a small child;

c. fitting said sleeping bag under the arms of the child by overlapping one side of said placket over said other side so that said bag is fitted below the arms and about the chest of the child; and d. fastening said sides of said placket by fastening means which are free of tie strings and straps.

13. A method for securing a sleeping bag about a small child, said method comprising the steps of:

a. forming a sleeping bag comprising two layers of material, said layers having a first open end formed from said two layers, said first end being free from interfering tie strings and straps, a second closed end of said bag formed from said two layers, said second closed end having a width equal to said first open end, said bag having approximately straight-line, closed sides connecting said layers and extending between said first and second ends of said bag with means defining a placket having two sides, formed in one of said layers at said first end;

b. placing said sleeping bag under the arms of a small child;

c. fitting said sleeping bag under the arms of the child by overlapping one side of said placket over said other side so that said bag is fitted below the arms and about the chest of the child; and d. fastening said sides of said placket by fastening means which are free of tie strings and straps.

* * * * *